US009631440B2

(12) United States Patent
Seyffert et al.

(10) Patent No.: US 9,631,440 B2
(45) Date of Patent: Apr. 25, 2017

(54) PACKER ASSEMBLY FOR AN OFFSHORE RISER AND METHOD OF USING SAME

(71) Applicant: NATIONAL OILWELL VARCO, L.P., Houston, TX (US)

(72) Inventors: Kenneth W. Seyffert, Houston, TX (US); Voltaire O. Sonnier, Houston, TX (US); Hoang Nguyen, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 12 days.

(21) Appl. No.: 14/014,159

(22) Filed: Aug. 29, 2013

(65) Prior Publication Data

US 2014/0083710 A1 Mar. 27, 2014

Related U.S. Application Data

(60) Provisional application No. 61/704,983, filed on Sep. 24, 2012.

(51) Int. Cl.
*E21B 7/12* (2006.01)
*E21B 17/08* (2006.01)
(Continued)

(52) U.S. Cl.
CPC ..... *E21B 17/085* (2013.01); *E21B 17/07* (2013.01); *E21B 19/004* (2013.01); *E21B 33/12* (2013.01)

(58) Field of Classification Search
CPC ..... E21B 17/07; E21B 17/085; E21B 43/106; E21B 33/12; E21B 19/004; E21B 19/006
(Continued)

(56) References Cited

U.S. PATENT DOCUMENTS 4,124,231 A 11/1978 Ahlstone
4,436,157 A 3/1984 Brooks
(Continued)

FOREIGN PATENT DOCUMENTS

CA 2883490 2/2015
DE 2841819 4/1980
DE 2841819 A1 4/1980

OTHER PUBLICATIONS

International Search Report and Written Opinion for PCT Application No. PCT/U52013/057357 dated Feb. 2, 2015, 10 pages.
(Continued)

*Primary Examiner* — Matthew R Buck
*Assistant Examiner* — Patrick Lambe
(74) *Attorney, Agent, or Firm* — Conley Rose, P.C.

(57) ABSTRACT

A packer assembly for sealing about a subsea riser is provided. The subsea riser is operatively connectable between a surface platform and subsea equipment. The packer assembly includes a packer housing and at least one packer. The packer housing is positionable about a telescoping assembly. The telescoping assembly operatively connects the subsea riser to the surface platform. The packer(s) are positionable along an inner surface of the packer housing to form a seal with the telescoping assembly and include a plurality of packer segments. Each of the packer segments has male and female connectors on each end thereof matably connectable to the male and female connectors of another of the segments to form a seal connection therebetween. The seal connection defines a non-linear leak path whereby leakage of fluid between the plurality of segments is resisted.

34 Claims, 14 Drawing Sheets

(51) Int. Cl.
*E21B 33/12* (2006.01)
*E21B 17/07* (2006.01)
*E21B 19/00* (2006.01)

(58) Field of Classification Search
USPC ..... 166/345, 346, 344, 250.17, 76.1; 285/145.1, 298, 302
See application file for complete search history.

(56) References Cited

U.S. PATENT DOCUMENTS

| | | | | |
|---|---|---|---|---|
| 4,496,172 | A | 1/1985 | Walker | |
| 4,662,785 | A | 5/1987 | Gibb et al. | |
| 4,844,511 | A | 7/1989 | Galle et al. | |
| 5,066,048 | A | 11/1991 | Farrell | |
| 5,184,681 | A * | 2/1993 | Fontenot | 166/367 |
| 5,259,459 | A | 11/1993 | Valka | |
| 6,070,669 | A | 6/2000 | Radi et al. | |
| 6,244,340 | B1 * | 6/2001 | McGlothen | E21B 23/002 166/117.6 |
| 6,557,637 | B1 | 5/2003 | Dore et al. | |
| 6,966,382 | B2 * | 11/2005 | Buckle et al. | 166/348 |
| 7,686,342 | B2 | 3/2010 | Jennings et al. | |
| 7,913,767 | B2 | 3/2011 | Larson et al. | |
| 2003/0111799 | A1 * | 6/2003 | Gilmore | 277/510 |
| 2005/0146137 | A1 | 7/2005 | Davidson et al. | |
| 2007/0131413 | A1 | 6/2007 | Millet et al. | |
| 2010/0270746 | A1 * | 10/2010 | Van Winkle | 277/322 |
| 2010/0326671 | A1 | 12/2010 | Buytaert et al. | |

OTHER PUBLICATIONS

English Abstract of DE2841819 A1 published Apr. 3, 1980, Downloaded May 1, 2015.
Office Action for Canadian Patent Application No. 2,883,490 dated Dec. 31, 2015, 3 pages.
International Preliminary Report on Patentability and Written Opinion for PCT Patent Application No. PCT/US2013/057357 dated Mar. 24, 2015, 8 pages.
European Patent Office Third Party Submission dated Aug. 28, 2015 for counterpart EPO Application No. 13763360.8, 13 pages.
English translation of DE2841819 A1 published Apr. 3, 1980, 5 pages.

* cited by examiner

PACKER ASSEMBLY FOR AN OFFSHORE RISER AND METHOD OF USING SAME

CROSS-REFERENCE TO RELATED APPLICATIONS

This application claims the benefit of U.S. Provisional Application No. 61/704,983 filed Sep. 24, 2012, the entire contents of which is hereby incorporated by reference.

BACKGROUND

The disclosure relates generally to techniques for performing wellsite operations. More specifically, the disclosure relates to techniques, such as risers, joints and/or connectors and related devices, for passage of fluid at a wellsite.

Oilfield operations may be performed to locate and drill for hydrocarbons. Once located, production operations may be performed to gather and collect valuable downhole fluids. During drilling operations, the recovered fluids may be, for example, drilling fluids and/or transient oil, gas and water. During production operations, the fluids may be produced hydrocarbons.

Some such oilfield operations are performed at offshore locations. Offshore platforms may be used to draw fluids from subsea locations to a surface vessel. Subsea equipment may be positioned about the sea floor to access fluid in subsurface formations. A production or drilling riser may extend from the subsea equipment to a platform to bring the fluid to the surface for capture. The riser may be, for example, a drilling riser or a production riser including a series of tubulars connected together to form a fluid path for passage of fluids.

The tubulars of the riser may be exposed to various subsea conditions, such as currents, fluid pressures, sea life, and the like, which may apply forces or otherwise affect performance of the tubulars. Various tubulars have been developed for use in subsea operations as described, for example, in U.S. Pat. Nos. 7,913,767, 7,686,342, 6,557,637, 6,070,669, 5,259,459, 5,066,048, 4,844,511, 4,662,785, 4,496,172, 4,436,157, 4,124,231, 20100326671, and 20050146137.

Some tubulars along the riser may be provided with various connection devices, such as joints to connect portions of the tubulars together, or to other components, such as the wellhead or the platform. Seals may be provided about the tubulars and/or connection devices to prevent leakage. Examples of risers and/or connectors are provided in U.S. Pat. No. 7,913,767 and 2003/0111799.

SUMMARY

In at least one aspect, the present disclosure relates to a packer assembly for sealing about a subsea riser. The subsea riser is operatively connectable between a platform and subsea equipment. The packer assembly includes a packer housing and at least one packer. The packer housing is positionable about a telescoping assembly. The telescoping assembly operatively connects the subsea riser to the platform. The packer(s) are positionable along an inner surface of the packer housing to form a seal with the telescoping assembly, and includes a plurality of packer segments. Each of the segments has male and female connectors on each end thereof matably connectable to the male and female connectors of another of the segments to form a seal connection therebetween. The seal connection defines a non-linear leak path whereby leakage of fluid between the segments is resisted.

The packer housing may have flanged ends, and/or pressure ports therethrough. The inner surface of the packer housing includes a first diameter portion and a second diameter portion. The first diameter portion may be larger than the second diameter portion and defines a shoulder therebetween. The packer may be positionable along the first diameter portion adjacent the shoulder.

The packer assembly may also include a compression ring, a spacer, and/or an o-ring. The packers may be positionable between the compression ring and the shoulder.

The packer(s) may include an inner packer and an outer packer, and/or a body portion and upper and lower rings. The body portion may have grooves. The packer(s) may include an upper portion and a lower portion with an indentation therebetween. The male and female connectors may each include at least one horizontal portion and at least one vertical portion. The horizontal and vertical portions may be linear, non-linear, offset, and/or linked. The male and female connectors may include tongue and groove connectors, and/or a bevel end section and the female connector comprises a bevel cavity to receive the bevel end. The leak path may be disjointed.

In another aspect, the disclosure relates to a telescoping assembly for operatively connecting a surface end of a subsea riser to a platform. A subsea end of the riser may be operatively connectable to subsea equipment. The telescoping assembly may include an inner barrel operatively connectable to the platform, an outer barrel operatively connectable to the subsea riser (the outer barrel slidingly receiving the inner barrel therein), and at least one seal assembly positionable about the inner and outer barrels to form a seal thereabout.

The packer assembly includes a packer housing and at least one packer. The packer housing is positionable about a telescoping assembly. The telescoping assembly operatively connects the subsea riser to the platform. The packer(s) are positionable along an inner surface of the packer housing to form a seal with the telescoping assembly, and includes a plurality of packer segments. Each of the segments has male and female connectors on each end thereof matably connectable to the male and female connectors of another of the segments to form a seal connection therebetween. The seal connection defines a non-linear leak path whereby leakage of fluid between the segments is resisted.

The seal assembly may include a platform flange operatively connectable to the platform and a platform seal, a collar, a latching mechanism, a guide ring, bracing, bellows, a bellows cover, an adapter spool, an inner barrel locking collar, a shoe assembly, and/or a shoe and a riser flange.

Finally, in another aspect, the disclosure relates to a method of forming a seal about a subsea riser. The subsea riser is operatively connected to a platform by a telescoping assembly. The method involves providing the telescoping assembly with at least one packer assembly. The packer assembly includes a packer housing positionable about the telescoping assembly and at least one packer positionable along an inner surface of the packer housing to form a seal with the telescoping assembly. The packer(s) include a plurality of packer segments. Each of the segments has male and female connectors on each end thereof. The method further involves resisting leakage of fluid between the plurality of segments by forming a seal connection with a non-linear leak path between the male and female connectors by matably connecting to the male and female connectors of the segments with another of the plurality of segment.

The resisting may involve squeezing the plurality of segments together in response to hydraulic pressure and/or compressing the at least one packer into the packer housing with a compression ring. The packer(s) may include an inner packer and an outer packer. The resisting may also involve pushing the outer packer against the inner packer in response to hydraulic pressure.

BRIEF DESCRIPTION OF THE DRAWINGS

So that the above recited features and advantages may be understood in detail, a more particular description, briefly summarized above, may be had by reference to the embodiments thereof that are illustrated in the appended drawings. It is to be noted, however, that the appended drawings illustrate only typical embodiments and are, therefore, not to be considered limiting in scope. The figures are not necessarily to scale and certain features and certain views of the figures may be shown exaggerated in scale or in schematic in the interest of clarity and conciseness.

FIG. 5 is an end view of the packer assembly shown as portion 5 of FIG. 2 having inner and outer packers.

DETAILED DESCRIPTION

The description that follows includes exemplary systems, apparatuses, methods, and instruction sequences that embody techniques of the inventive subject matter. However, it is understood that the described embodiments may be practiced without these specific details.

The techniques herein relate to a telescoping assembly for adjustably connecting a tubular riser to a surface platform. The telescoping assembly includes a packer assembly with inner and outer packers positionable therein to seal the flexible assembly. The inner packer includes two (or more) segments with mated ends sealably connectable together to form a continuous ring. The mated ends provide a mated seal connection with an interlocking geometry therebetween. The interlocking geometry may define a longitudinal (or axial) leak path therebetween to prevent the passage of fluid therethrough. The leak path may have horizontal, vertical and/or curved portions that provide an overall non-linear geometry between the segments.

With some techniques, the leak path of the packer is configured to block fluid flow by forcing rubber of the packer in a direction perpendicular to a direction of force applied thereto. In such cases, this perpendicular sealing force may be increased to force rubber circumferentially (e.g., 90 degrees) to close vertical splits between portions of an inner packer. In other cases, the perpendicular sealing force may be used to press portions of the inner packer against the inner surface of the packer assembly such that a leak path between the segments is blocked. The inner packer may be configured to reduce a clamp force therein and reduce the amount of pressure required to block the flow along the leak path. (For example, the pressure may be applied on the packers by a driller to seal off mud leakage around the inner packer.) The reduced pressure inner packer may be configured to operate at higher pressures (e.g., from about 500 to about 1000 psi (35.16-70.32 kg/cm)) during short periods (e.g., emergency situations) thereby reducing wear on the inner packer. The inner packer may also be used to address leakages that may create environmental issues.

Figure 1:
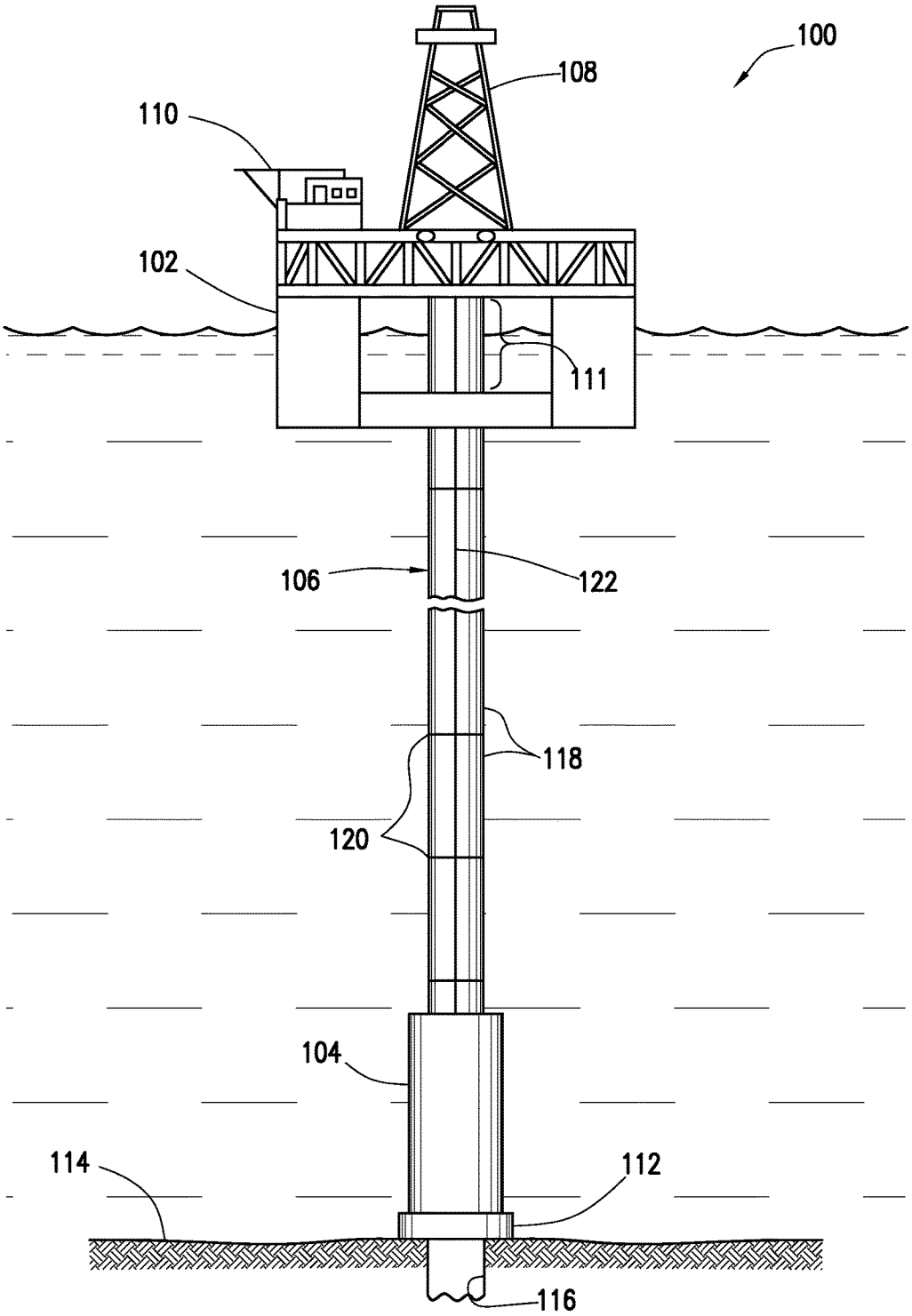
FIG. 1 is a schematic view of an offshore wellsite having a riser extending from a surface platform to subsea equipment with a telescoping assembly therebetween.

FIG. 1 depicts a wellsite 100 having a surface platform 102 and subsea equipment 104, with a riser 106 therebetween. The surface platform 102 has a rig 108 and other surface equipment 110 for operating the wellsite 100. The subsea equipment 104 is positioned about a wellhead 112 located on sea floor 114 adjacent a wellbore 116. The subsea equipment 104 is schematically depicted as a component positioned adjacent the wellhead 112, but may be positioned about the sea floor 114 and may include various subsea components, such as blowout preventers, manifolds and/or other subsea devices for performing subsea operations. While FIG. 1 shows a subsea application, it will be appreciated that the techniques herein may be used in a variety of land or water based applications.

The riser 106 is a system of tubulars 118 that forms a long tube for joining the drilling rig 108 on the platform 102 to the wellhead 112 on the sea floor 114. The riser 106 may also be provided with one or more external conduits 122 for performing various functions, such as an electrical or fluid conduit (e.g., choke and kill, glycol, hydraulics, and/or riser-fill-up, etc.) The conduit(s) 122 may run along the riser 106 from the surface platform 102 to the subsea equipment 104. The conduits 122 may include various tubing, cables or other passage mechanisms for the passage of fluids. The tubulars 118 may be tubular members with a tubular connection 120 therebetween.

A telescoping assembly 111 may be positioned about the riser 106 for operatively connecting with the floating platform 102. The telescoping assembly 111 has telescoping portions that permit the platform 102 to adjustably position relative the riser 106, for example, as the platform 102 moves with the sea water.

Figure 2:
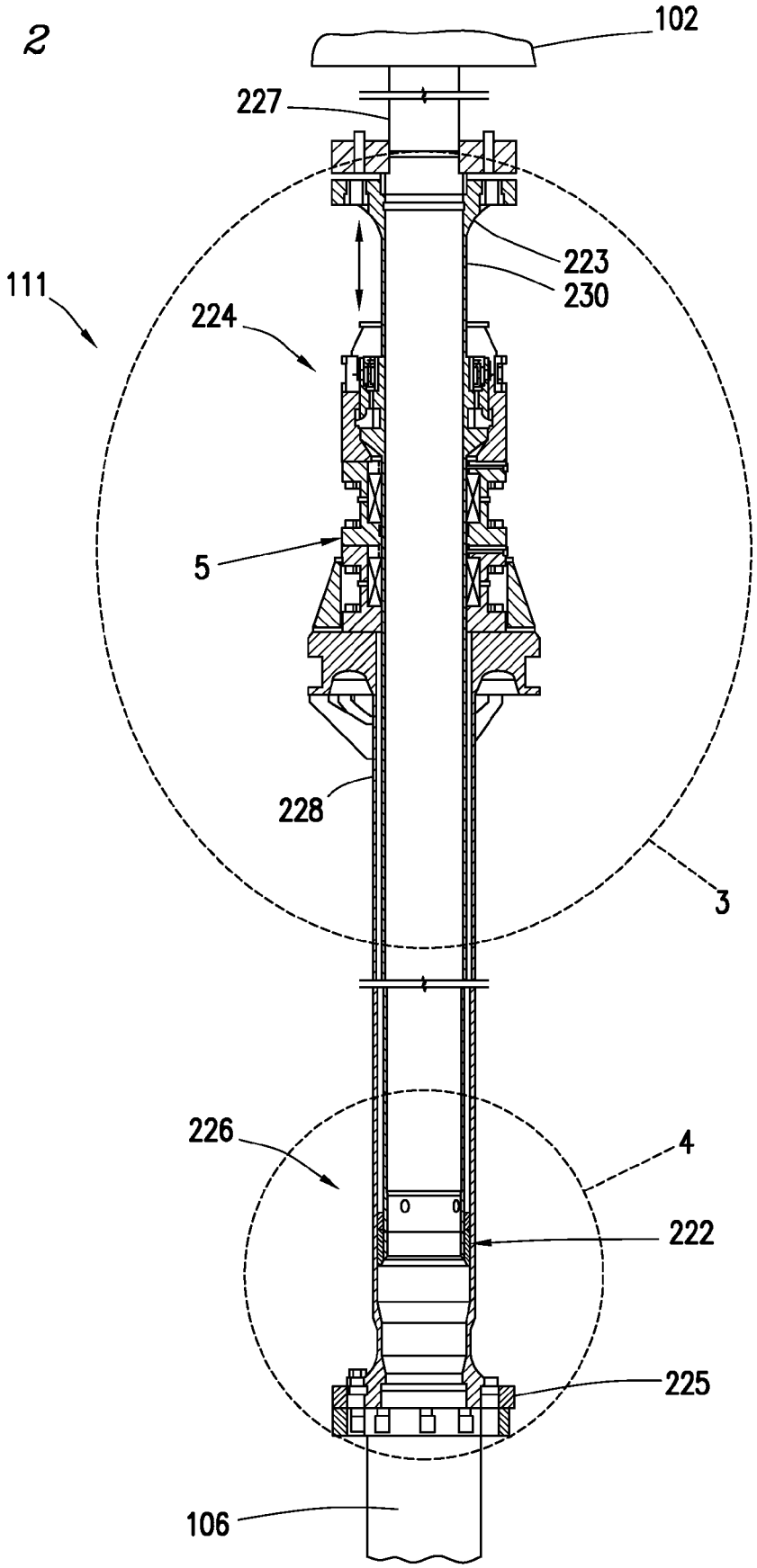
FIG. 2 is a longitudinal, cross-sectional view of the telescoping assembly of FIG. 1 having a packer assembly.

FIG. 2 depicts the telescoping assembly 111 in greater detail. The telescoping assembly 111 includes a seal assembly 224 at a surface end and a shoe assembly 226 at a subsea end thereof with an inner barrel 230 and an outer barrel 228 therebetween. The seal assembly 224 has a platform flange 223 operatively connectable to the platform 102 via a platform assembly 227. The platform assembly 227 may include various connectors, such as a flex joint, diverter, etc. At the lower end of the telescoping assembly 111, the shoe assembly 226 has a shoe 222 and a riser flange 225 operatively connected to the riser 106 as schematically depicted.

The inner barrel 230 is connected to the platform flange 223 at a surface end thereof. A lower end of the inner barrel 230 slidingly extends into the outer barrel 228 for telescopic movement therebetween, and is threaded into the shoe 222. The outer barrel 228 connects to the riser flange 225 of shoe assembly 226. The outer barrel 228 receives the inner barrel 230 therein for sliding and telescopic movement therebetween. The telescopic movement of the inner barrel 230 relative to the outer barrel 228 allows the telescoping assembly 111 to extend and retract as needed.

Figure 3:
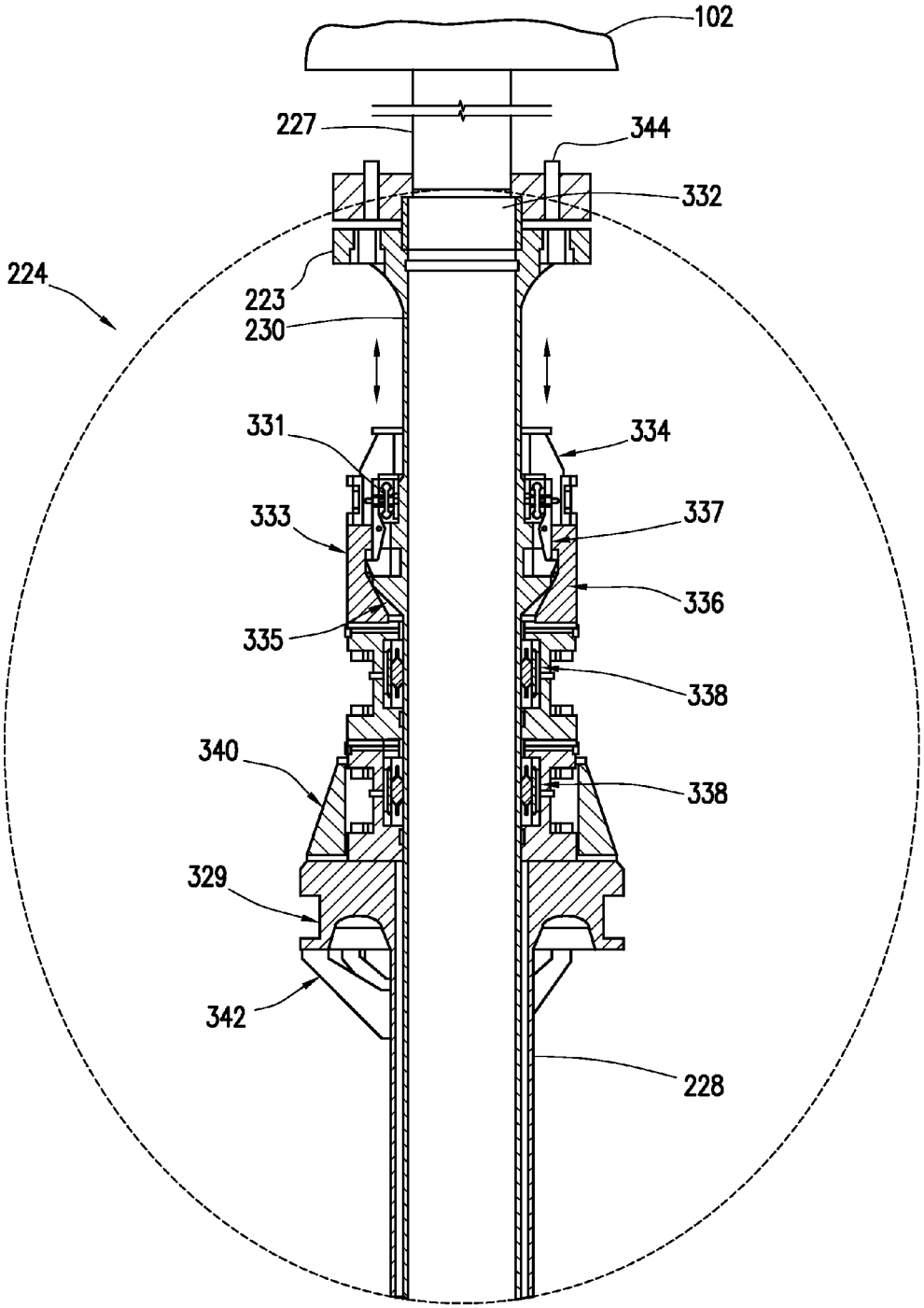
FIG. 3 is a longitudinal, cross-sectional view of an upper portion 3 of the telescoping assembly of FIG. 2.

FIG. 3 shows a portion of the telescoping assembly 111 with the seal assembly 224 of FIG. 2 in greater detail. As shown in this view, the seal assembly 224 includes the platform flange 223 and a platform seal 332. The platform flange 223 is depicted as a circular member at a surface end of the inner barrel 230. As used herein circular shall refer to any elliptical shape, and non-elliptical may also optionally be used. The platform flange 223 provides a contact surface for operative connection to the platform assembly 227. The platform assembly 227 may be connected, for example, by bolts 344 to the platform flange 223.

The platform seal 332 is positionable along an inner surface of the platform flange 223 and the platform assembly 227 for providing a seal there along. The platform seal 332 is a circular member and may be made of a flexible material mounted in a removeable steel holder. The platform seal 332 may sealingly receive the inner barrel 230 for sealing connection therebetween.

The seal assembly 224 also includes a collar 334, a latching mechanism 336, packer assemblies 338, and a guide ring (or collar) 340 positioned about the inner barrel 230. The collar 334 is positioned about a surface end of the latching mechanism 336. The packer assemblies 338 and guide ring 340 are positioned at a riser end of the latch mechanism 336. The latching mechanism 336 may be a conventional latch having, for example, locking dogs, collars, bolts and other devices to secure the outer barrel 228 about the inner barrel 230 as needed while permitting the inner barrel 230 to slidingly move therein. Other devices, such as a bellows 331, a bellows cover 337, an adapter spool 333 and an inner barrel locking collar 335 may also be provided along the seal assembly 224 to support operation thereof.

An outer barrel tension ring receiver 329 is positioned about the outer barrel 228 adjacent the guide ring 340. A tension ring (not shown) may be attached to the outer barrel tension ring receiver 329. Packer assemblies 338 are positioned between the latching mechanism 336 and the outer barrel tension ring receiver 329. The packer assemblies 338 are attached to the surface end of the outer barrel 228. The guide ring 340 is positioned about the packer assembly 338 adjacent the outer barrel 228. The outer barrel tension ring receiver 329 is positioned adjacent a subsea end of the guide ring 340.

Two packer assemblies 338 are shown stacked together to provide a seal between the inner barrel 230 and outer barrel 228 and to prevent leakage therebetween. Two packer assemblies 338 are depicted, but one or more may be used. The surface (or upper) packer assembly 338 may be used as the primary packer. The riser (or lower) packer assembly may act as a backup for redundant leakage prevention, for example, should the upper packer fail.

Bracing 342 extends between the outer barrel 228 and the outer barrel receiver 329 and fixedly secures the outer barrel 228 thereto. The outer barrel 228 may be provided with seals, tension rings or other devices to secure the outer barrel 228 in position. The outer barrel 228 supports the guide ring 340 adjacent thereto and about the packer assembly 338.

Figure 4:
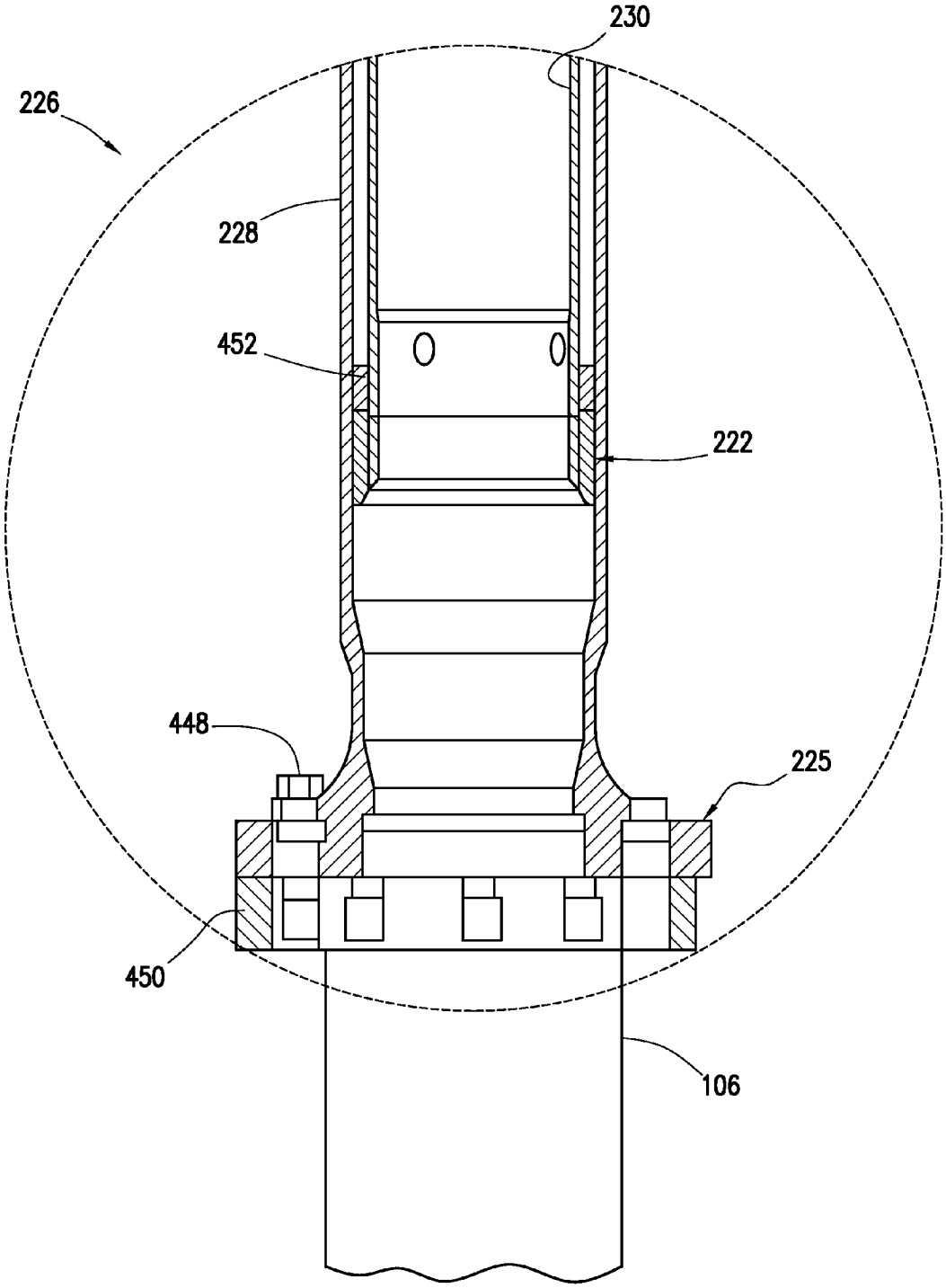
FIG. 4 is a longitudinal, cross-sectional view of a lower portion 4 of the telescoping joint assembly of FIG. 2.

FIG. 4 shows the shoe assembly 226 in greater detail. The shoe assembly 226 includes the riser flange 225 and the shoe 222. The riser flange 225 is operatively connectable to a surface end 450 of the riser 106. The riser flange 225 is a circular member that may be connected to the riser 106 by bolts 448.

The outer barrel 228 is connected to the riser flange 225 (e.g., by weld). The shoe 222 is positioned in the outer barrel 228. The shoe 222 receivingly engages the inner barrel 230. The shoe 222 may have a shoulder (or other surface) 452 to limit the extension of the telescopic assembly 111 (FIG. 1).

Figure 5:
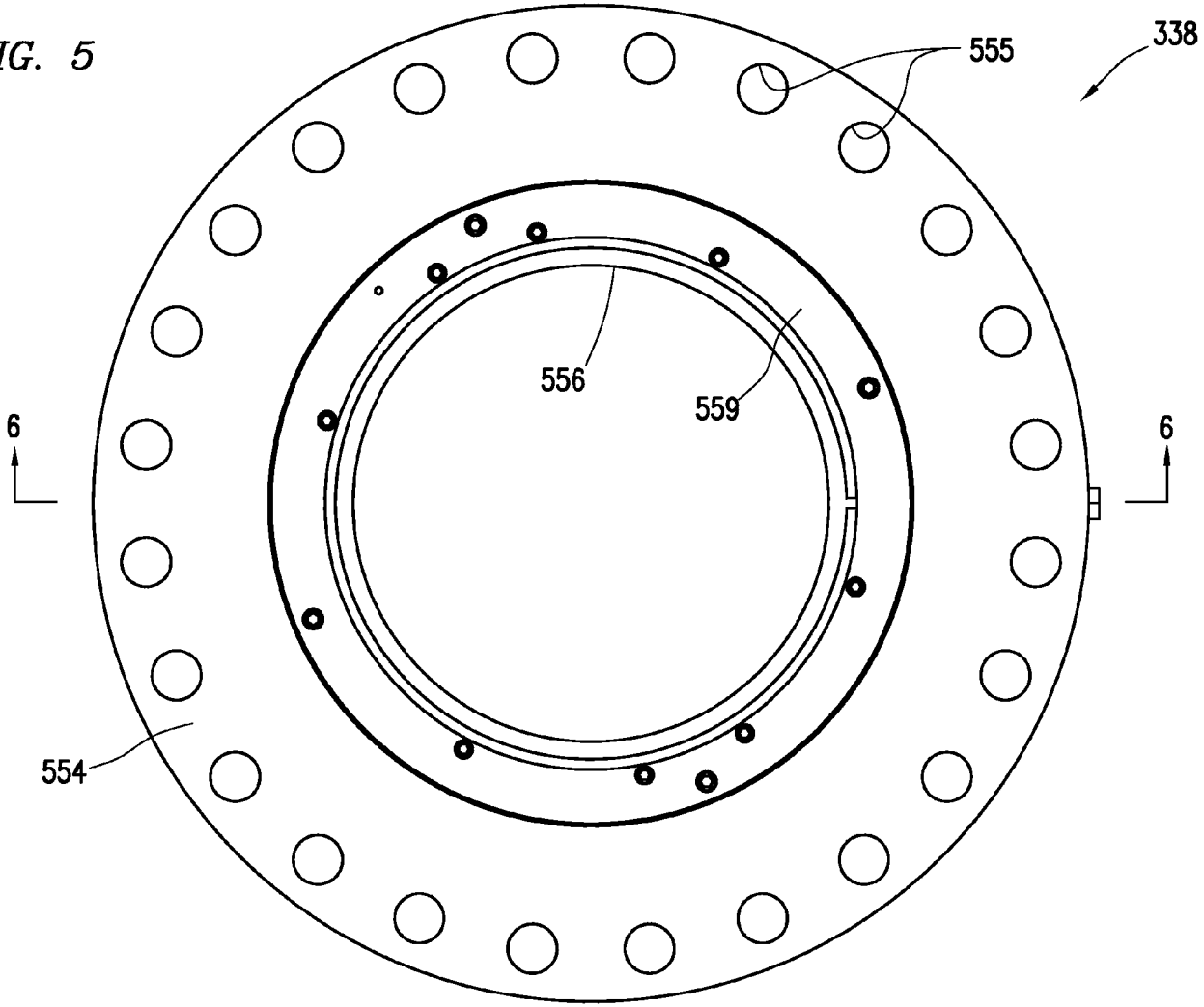
FIG. 5 is an end view of the packer assembly of FIG. 2 having inner and outer packers.
Figure 6:
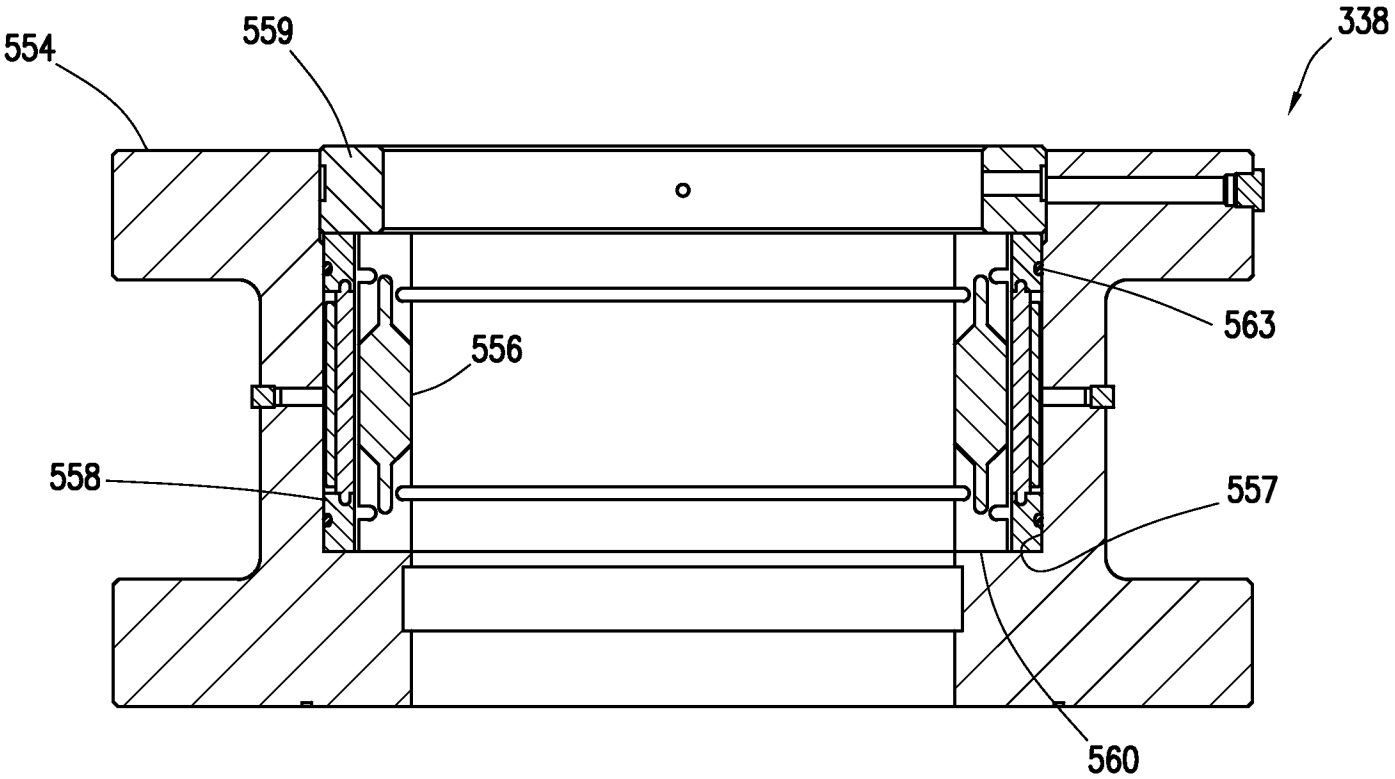
FIG. 6 is a longitudinal cross-sectional view of the packer assembly of FIG. 5 taken along line 6-6.
Figure 7:
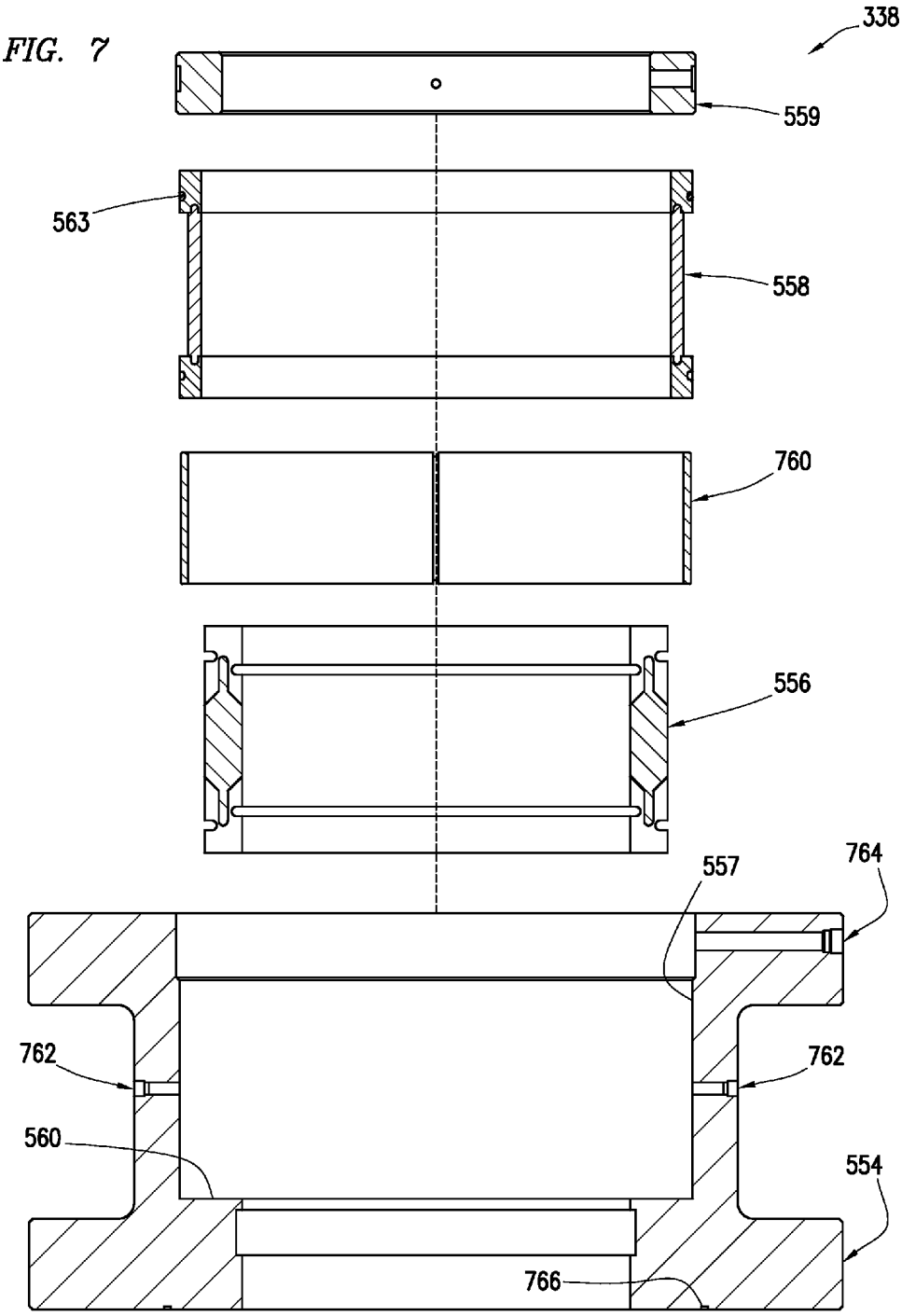
Figure 8:
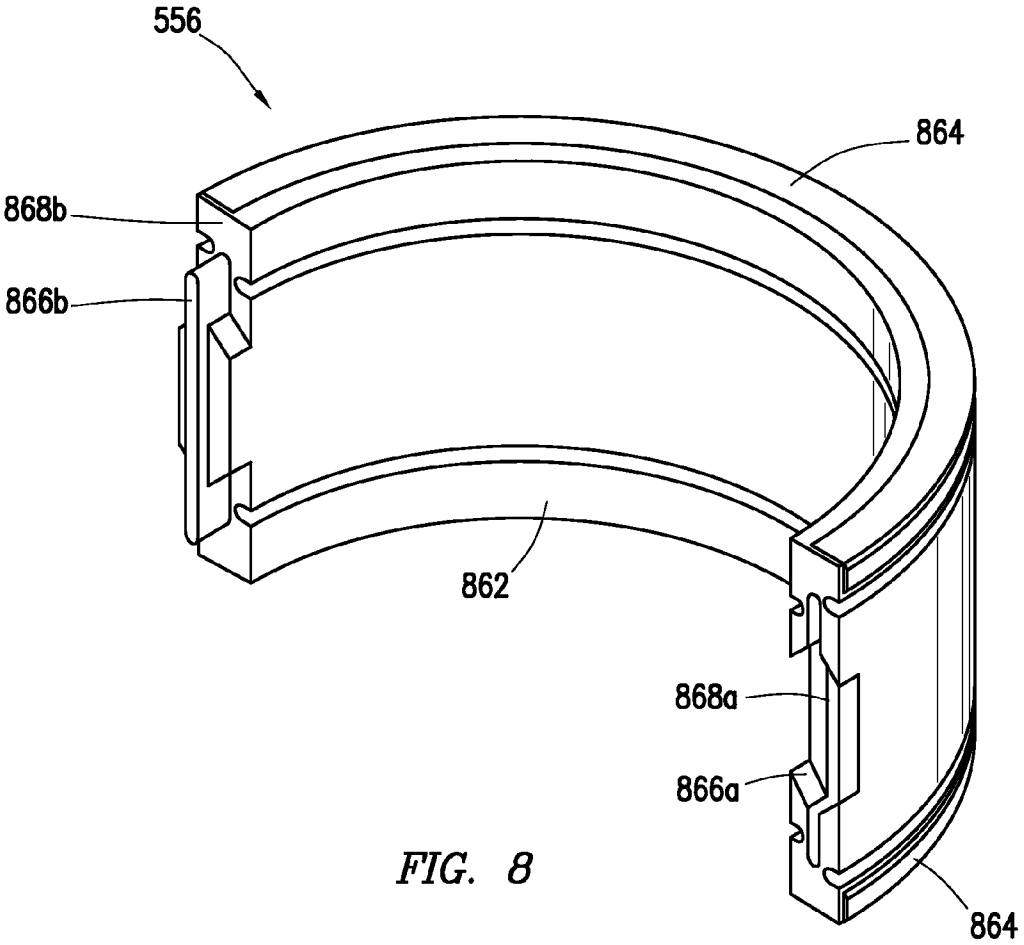
FIG. 8 is a perspective view of a segment of the inner packer of FIG. 5.
Figure 11:
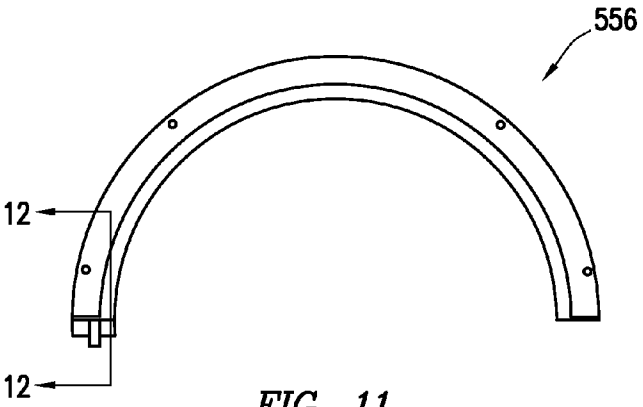
FIG. 11 is a top view of the segment of the inner packer of FIG. 10.
Figure 12:
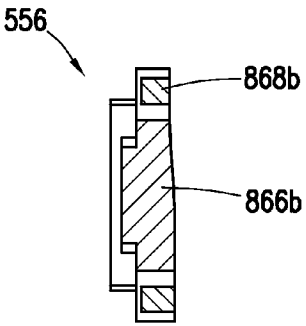
FIG. 12 is a cross-sectional view of the segment of the inner packer of FIG. 11 taken along line 12-12.
Figure 9A:
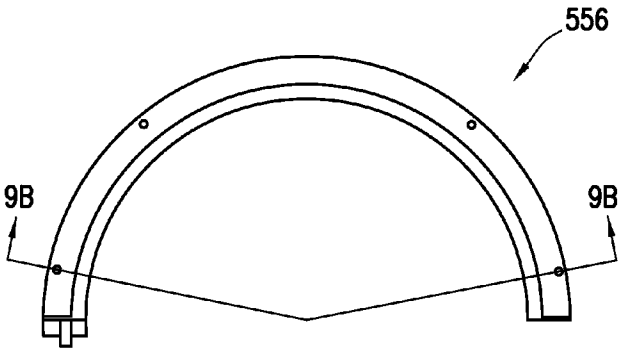
FIG. 9A is a top view of the segment of the inner packer of FIG. 8.
Figure 9B:
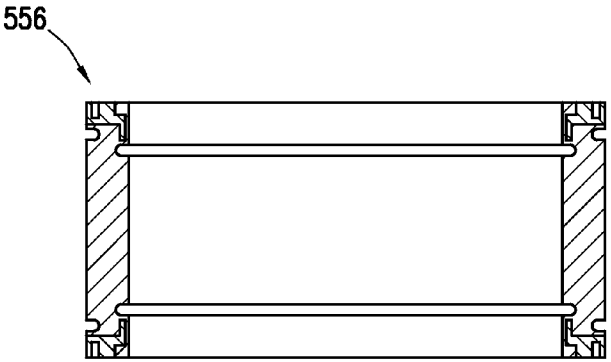
FIG. 9B is a cross-sectional view of the segment of the inner packer of FIG. 9A taken along lines 9B-9B.
Figure 10:
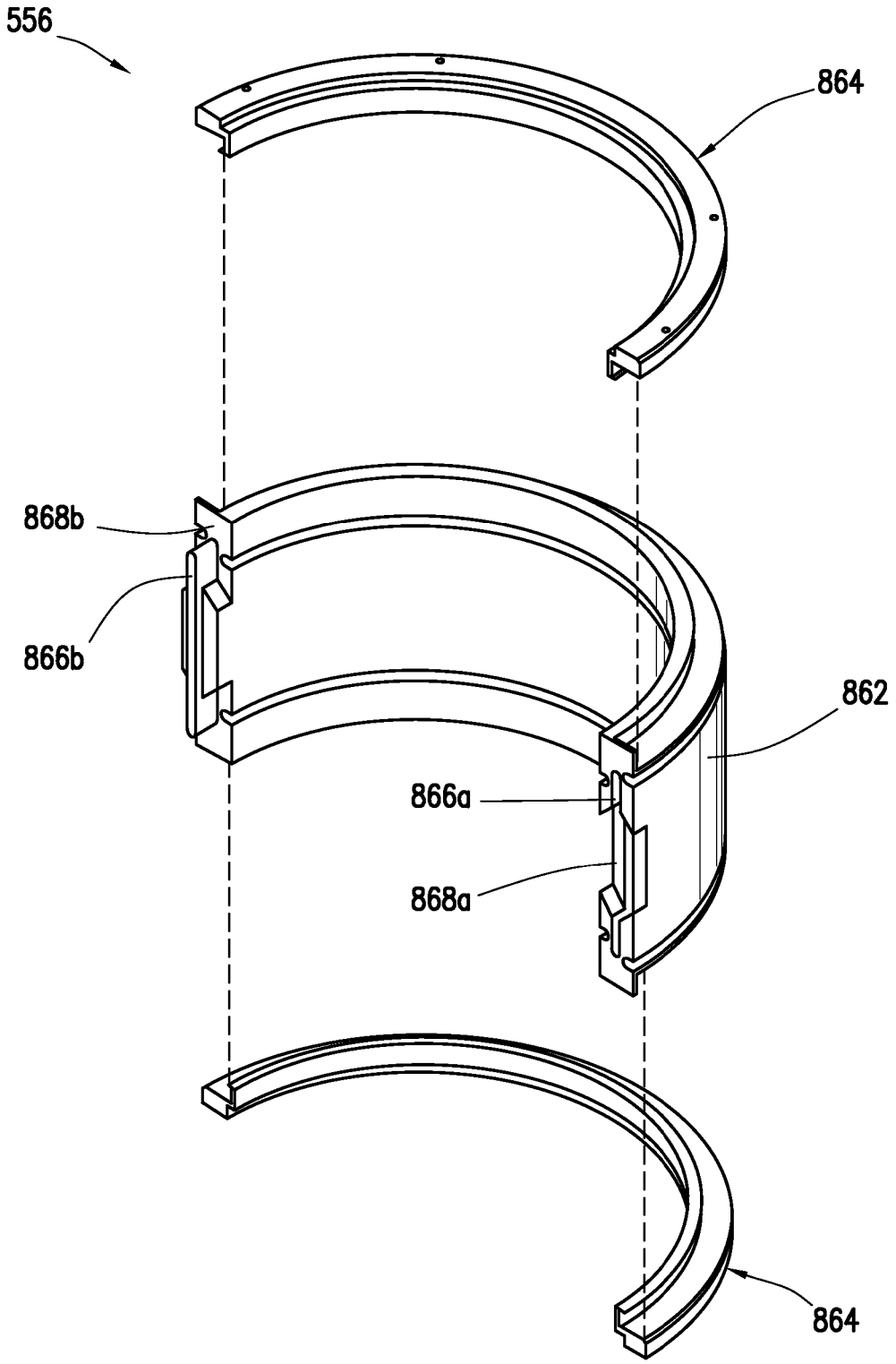
FIG. 10 is an assembly view of the segment of the inner packer of FIG. 8.

FIGS. 5-7 depict various aspects of the packer assembly 338. FIGS. 5 and 6 show top and longitudinal cross-sectional views, respectively, of the packer assembly 338. Each packer assembly 338 includes a packer housing 554, an inner packer 556, an outer packer 558 and a compression ring 559. The packer housing 554 is a circular member with flanged platform and surface ends on opposite sides thereof. The packer housing 554 is provided with bolt holes 555 for operative connection with adjacent components, such as another packer assembly 338 and/or outer barrel receiver 329 as shown in FIG. 3.

The packer housing 554 has an inner housing surface 557 and a shoulder 560 defining different diameters along the inner housing surface 557 for receiving the packers 556, 558. As shown, there are two diameters along the inner housing surface 557 with a surface diameter being larger than a subsea diameter thereof, but any number and dimensions may be selected. The inner and outer packers 556, 558 are concentrically positioned in the packer housing 554 and in abutment against shoulder 560. The compression ring 559 is positioned adjacent the packers 556, 558 along the inner surface 557 of the packer housing 554. The inner packer 556 is split into multiple segments (e.g., for quick field change). While the inner packer is depicted as being split into two segments, two or more may be used. The outer packer is solid and sealed with o-rings 563 thereabout.

FIG. 7 shows an exploded view of the packer assembly 338. As shown in this view, the packer assembly 338 may also include a spacer 760. The spacer 760 is positioned about the outer packer 558 and may be used, for example, to facilitate assembly.

The packer housing 554 may also be provided with ports, such as water port 764 and pressure ports 762 connected via hoses to a remote control system. Seals, gaskets or other features may be provided about the packer assembly to facilitate sealing. For example, o-ring 766 may be positioned at the riser end of the platform housing 554 for sealing engagement with the outer barrel 228 (see, e.g., FIG. 3).

FIGS. 8-12 show a portion of the inner packer 556 in greater detail. As shown in this view, the inner packer 556 may be made of multiple segments that are connectable to form the circularly shaped inner packer 556 positionable along the packer housing 554 as shown in FIGS. 5-7. As shown in FIGS. 8-12, the inner packer 556 has two segments that form a single inner packer 338. While two segments are depicted, two or more may be used.

The inner packer 556 includes body portions 862, and upper and lower ring portions 864. The body portion 862 may be made of a non-metal, such as molded polyethylene, polyurethane, rubber and the like, for example, to provide wear resistance and sealing capabilities. The selected material may allow for limited movement and/or flexion during operation. The body portion 862 may have various grooves for flexing. The inner packer 566 is positioned by the metal rings of the outer packer, with the compression ring on top and the housing shoulder on the bottom.

The upper and lower rings 864 are positionable adjacent the body portion 862 on opposite ends thereof. The upper ring 864 is positionable in engagement with the compression ring 559, for example, by bolts (not shown), as schematically shown in FIG. 6. The lower ring 864 is positionable in engagement with the shoulder 560 of the packer housing 554 as also shown in FIG. 6.

Mated packer connectors 866*a,b* are provided between the segments for sealing engagement therebetween. The mating as shown is a tongue and groove type connection, but may be in other configurations. The packer connectors 866*a,b* are positioned at connection ends of the body portion 862. Each segment has a female connector 866*a* and a male connector 866*b* at each end thereof. The male and female connectors 866*a,b* are positioned on connection faces 868*a,b* of the body portion 862.

The male and female connectors 866*a,b* are depicted as non-linear connectors extending longitudinally along each connection face of the body portion 862. When two segments are positioned together, the male connector 866*b* of a first packer segment is sealingly and interlockingly connectable with the female connector 866*a* of a second packer segment. When the segments are joined, the sealed connection between the segments defines a leak path therealong to prevent the flow of fluid therethrough.

FIGS. 13A-14B depict various seal connections usable between segments of an inner packer, such as the inner packer 556 described herein. FIGS. 13A-13D depict various inner packers 556*a-d* having non-linear seal connections 1370*a-d* defining non-linear leak paths 1372*a-d* therebetween. As used herein non-linear leak paths refer to an overall non-linear configuration of a leak path extending from a surface end to a subsea end of the inner packer. As shown in FIGS. 13A-13D, portions of the leak path may be linear, but the linear flow from end to end is interrupted by portions that deviate from a vertical line along the inner packer. While non-linear leak paths are shown, certain arrangements may incorporate linear connectors with linear leak paths. The sealed connections 556*a-d* provide various configurations of a non-linear connection, such as a tongue and groove arrangement. The various segments are configured such that any two segments may be assembled together to form the solid ring inner packer.

Figure 13B:
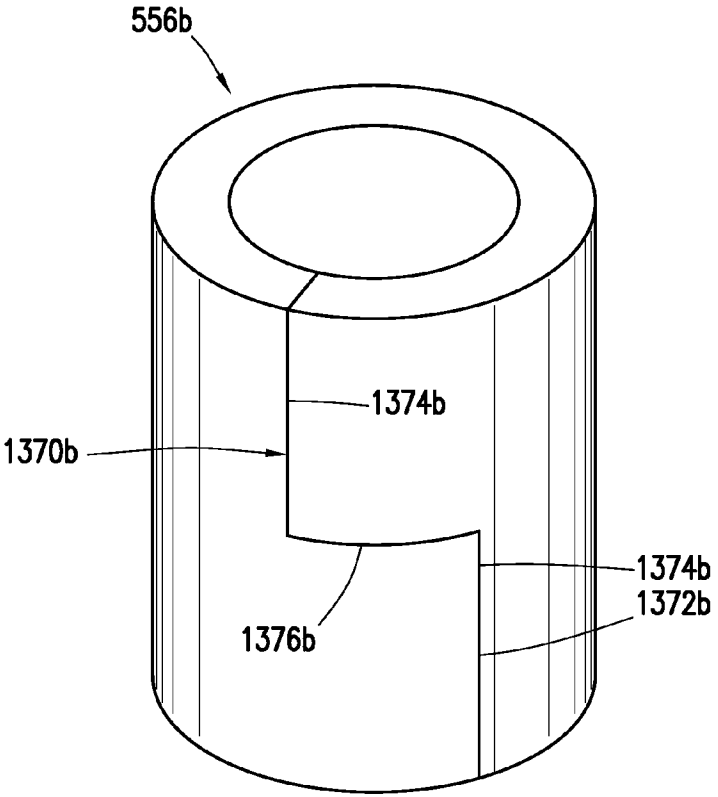
FIGS. 13A-13D are schematic perspective views of various inner packers having various seal connections.

The non-linear seal connections 1370*a-d* have interlocking pieces therealong which interlockingly engage to create the non-linear leak path along the length of the inner packer 556*a-d*. As shown in FIGS. 13A-13D, the leak path has discrete portions to prevent a straight vertical line (or linear) path between the segments. As shown in FIGS. 13B-13D, the leak path defined by the connection may be zig-zagged (or jagged).

Figure 13A:
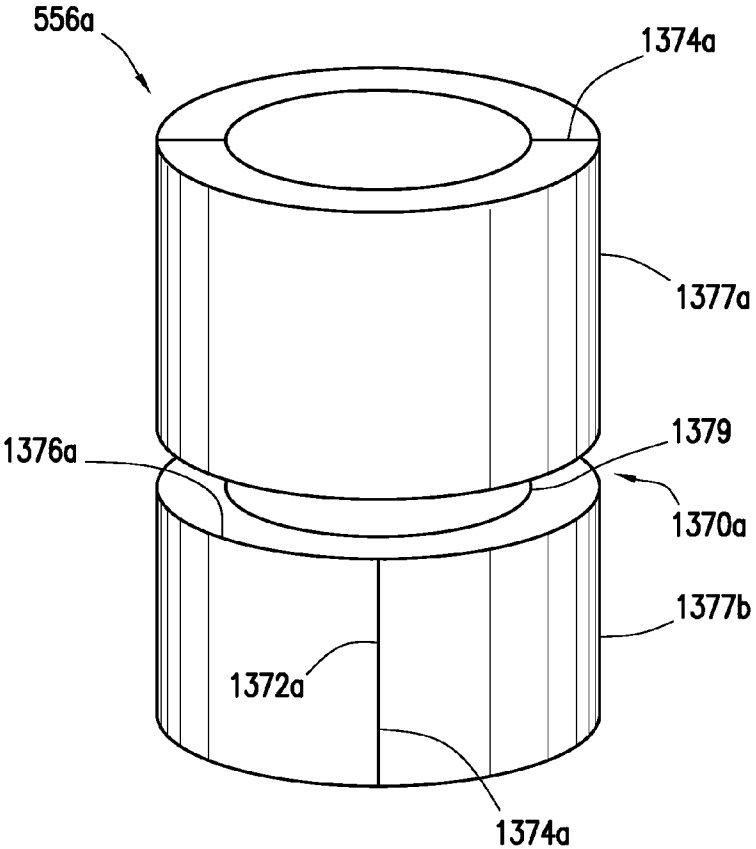
Figure 13D:
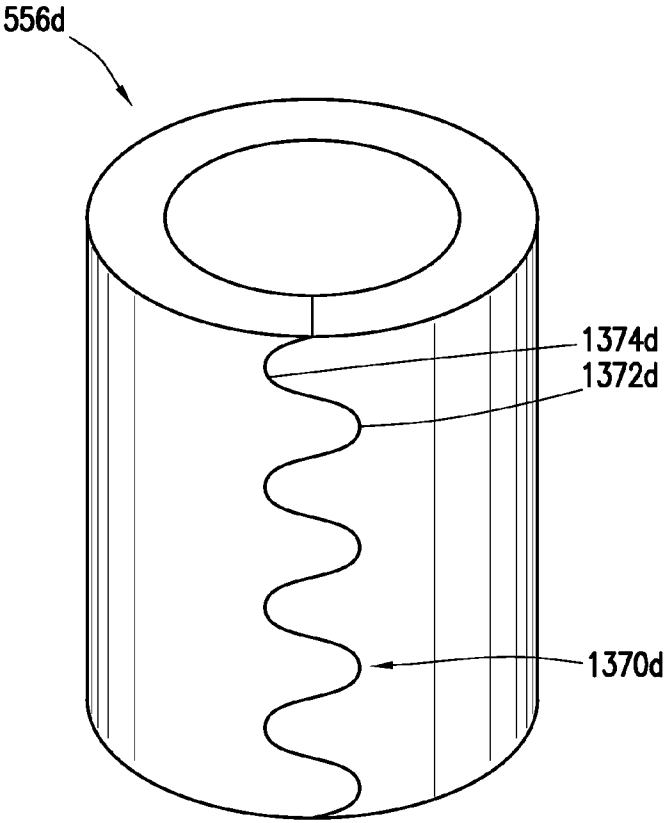
Figure 13C:
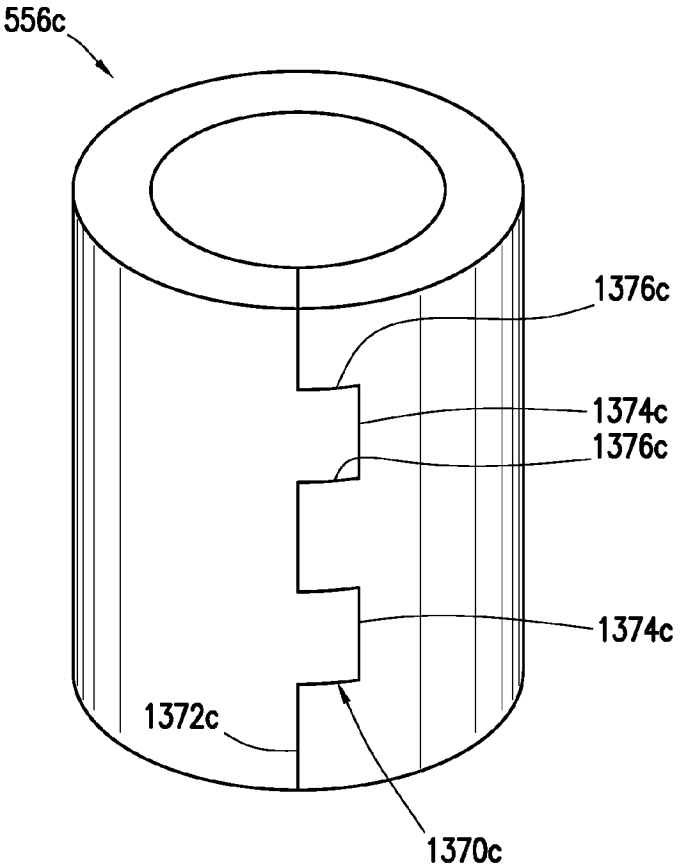

In the configuration of FIG. 13A, the leak path 1372*a* has offset longitudinal and horizontal portions 1374*a*, 1376*a* that provide a disjointed path to block the passage of fluid. The inner packer 556*a* has an upper portion 1377*a* and a lower portion 1377*b* with an indentation 1379 therebetween. The inner packer 556*a* is split horizontally and vertically at locations staggered 90 degrees apart to define an offset path. In FIG. 13B, the leak path 1372*b* has linked longitudinal portions 1374*b* and horizontal portions 1376*b* to define an L path. In FIG. 13C, the leak path 1372*c* has multiple longitudinal portions 1374*c* and horizontal portions 1376*c* forming a stepped (or labyrinth) path. FIG. 13D is similar to FIG. 13C, except that the leak path 1372*d* has curved portions 1374*d* that define a wavy path.

Figure 14B:
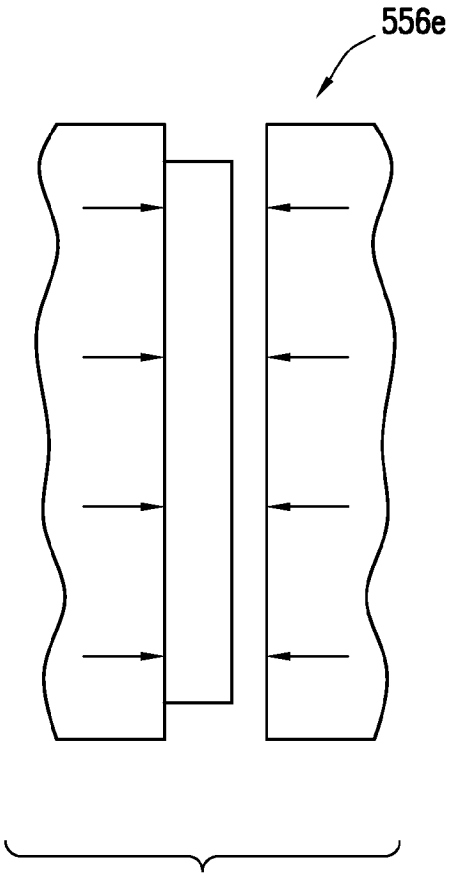
FIGS. 14A-14B are schematic diagrams depicting forces on an interlocking seal connection between segments of an inner packer.
Figure 14A:
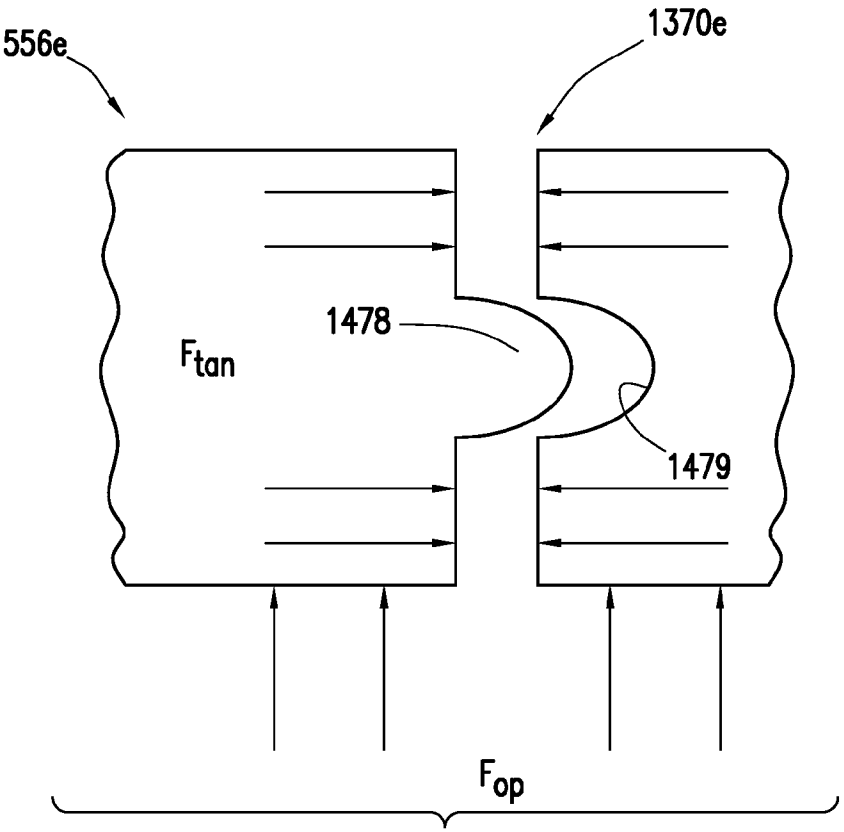
Figure 15A:
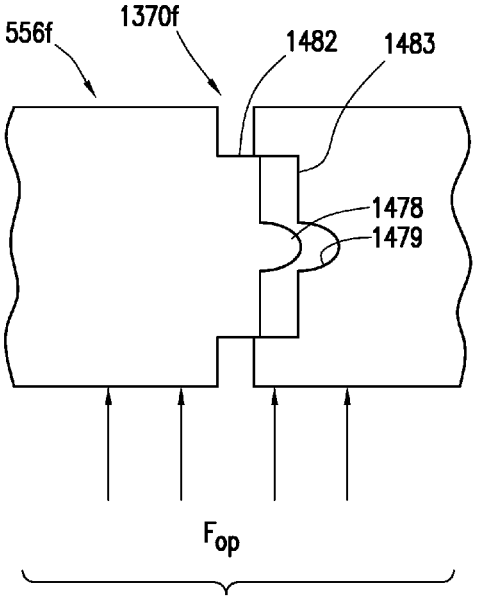
FIGS. 15A-15C are schematic diagrams depicting forces on another interlocking seal connection between segments of another inner packer.
Figure 15B:
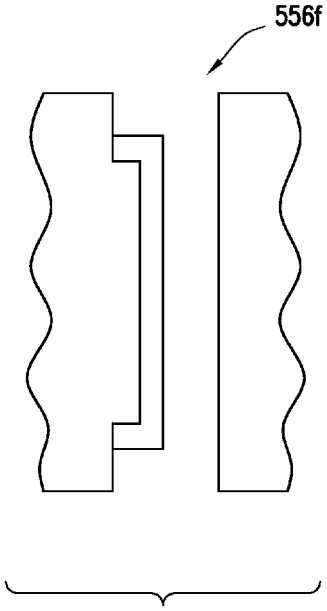
Figure 15C:
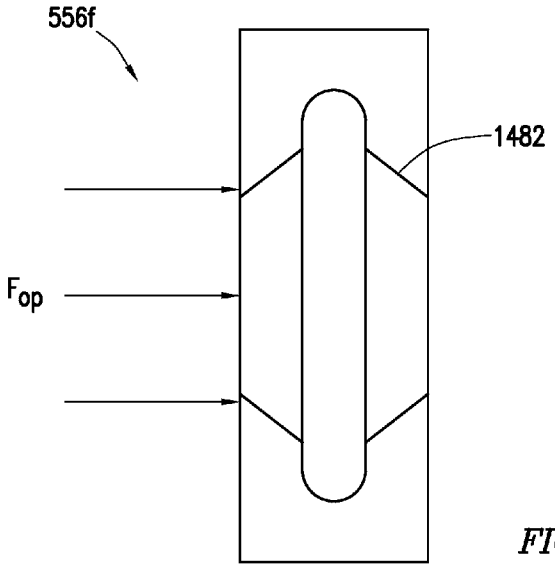

FIGS. 14A-15C depict examples of forces applied to a seal connection 1370*e,f* between segments of inner packers 556*e,f*. FIGS. 14A and 15A show the seal connections 1370*e,f* from a top view looking down onto the seal connections 1370*e,f*. FIGS. 14B and 15B are side views of the seal connections 1370*e,f*. FIG. 15C is an end view of the seal connection 1370*f*. These figures depict views of the seal connection 1370*e,f* showing the interlocking tongue 1478 and groove 1479 connection therebetween.

As shown in FIGS. 14A and 14B, forces $F_{op}$ from an outer packer (e.g., 558 of FIG. 6) may be applied along an outer surface of the inner packer 556*e,f*. In cases where a linear seal is provided, a pressure or force $F_{tan}$ may be used to seal the leak path. $F_{tan}$ is produced by rubber squeeze or distortion resulting from $F_{op}$ as shown in FIG. 14A. In this case, an additional force $F_{op}$ may also be required resulting in additional squeeze on the seal connection 1370*e*.

In cases with a non-linear seal connection (e.g., in FIGS. 5-13D), the force $F_{tan}$ is not required to seal the leak path and may be considered negligible as shown in FIGS. 15A-15C. In this version, the connection 1370*f* is formed between a male end having the tongue 1478 on a beveled end 1482 and a female end having a groove 1479 in a bevel cavity 1483. Leak path sealing may be a result of force $F_{op}$ compressing the bevel end sections 1482. Additional force $F_{op}$ may not be needed to seal against the inner barrel to seal the leak path, e.g., where the force may be transmitted through the interlocking beveled section 1482.

In operation as shown in the figures, the telescoping assembly 111 provides a movable, sealed connection between the riser 106 and the floating platform 102. The packer assembly 338 of the telescoping assembly 111 includes the housing 554 and inner and outer packers 556, 558 form a seal about the telescoping assembly 111. Air or hydraulic pressure may be introduced between the outer packer 558 and the housing 554 and may be inflated to squeeze the inner packer 556 onto the movable inner barrel 227 of the packer assembly 338 sealing the returning drilling mud in the annulus between the drill pipe and riser 106.

The nonlinear seal connections (e.g., 370*a-d*) may be positioned along the inner packer 556. Since a split between the segments is vertical and along the leak path direction, a seal is formed against the inner barrel 230 by squeezing the inner packer 556*a-d* with hydraulics to push the outer packer 558 to force the split in the inner packer 556 together circumferentially to close any small gap that may remain between the segments of the inner packer 556 at the sealed connection. When a non-linear connection is provided between the segments, the force that seals the mud circumferentially also seals the leak path.

When the outer packer 558 is pressured up and squeezes the inner packer 556, the non-linear leak path may be used to stop the leakage before a vertical split line of the sealed connection is squeezed together. The hydraulic pressure necessary to seal may be all the pressure that is needed to squeeze the inner packer against the inner barrel without additional pressure that would be required to squeeze the rubber or polyurethane against a linear split line. The non-linear seal connection may be configured to reduce the clamping force between the inner packer 556 and the inner barrel 228. The interlocking geometry of the seal connection may continue to provide sealing as the packer 556 wears through.

It will be appreciated by those skilled in the art that the techniques disclosed herein may be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more packer assemblies with one or more inner and outer packers may be provided with one or more segments with a variety of non-linear connectors therebetween to form a sealed mated connection defining a leak path therebetween.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A packer assembly for sealing about a subsea riser, the subsea riser operatively connectable between a platform and subsea equipment, the packer assembly comprising:

a packer housing sealably connecting portions of a telescoping assembly, wherein the telescoping assembly is positioned along the subsea riser and operatively connects the subsea riser to the platform; and at least one packer positionable along an inner surface of the packer housing to form a seal with the telescoping assembly, the at least one packer comprising a plurality of packer segments, wherein each of the plurality of packer segments has a male connector on one end and a female connector on another end thereof, wherein the female connector of each of the plurality of packer segments is configured to mate with and form a seal connection with the male connector of another of the plurality of packer segments, wherein the seal connection defines a non-linear leak path configured to resist leakage of fluid between the plurality of packer segments, and wherein the non-linear leak path extends from a surface end to a subsurface end of the at least one packer.

2. The packer assembly of claim 1, wherein the packer housing has flanged ends.

3. The packer assembly of claim 1, wherein the packer housing has pressure ports therethrough.

4. The packer assembly of claim 1, wherein the inner surface of the packer housing comprises a first diameter portion and a second diameter portion, the first diameter portion being larger than the second diameter portion and defining a shoulder therebetween, the at least one packer positionable along the first diameter portion adjacent the shoulder.

5. The packer assembly of claim 4, further comprising a compression ring, the at least one packer positionable between the compression ring and the shoulder.

6. The packer assembly of claim 1, wherein the at least one packer comprises an inner packer and an outer packer.

7. The packer assembly of claim 1, wherein the at least one packer comprises a body portion and upper and lower rings.

8. The packer assembly of claim 7, wherein the body portion has grooves.

9. The packer assembly of claim 1, wherein the at least one packer comprises an upper portion and a lower portion with an indentation therebetween.

10. The packer assembly of claim 1, wherein the male and female connectors each comprise at least one horizontal portion and at least one vertical portion.

11. The packer assembly of claim 10, wherein the at least one horizontal and vertical portions are linear.

12. The packer assembly of claim 10, wherein the at least one horizontal and vertical portions are non-linear.

13. The packer assembly of claim 10, wherein the at least one horizontal and vertical portions are one of offset and linked.

14. The packer assembly of claim 10, wherein the male connector of each of the plurality of packer segments comprises:

a beveled end; and a tongue extending from the beveled end;

wherein the female connector of each of the plurality of packer segments comprises:

a beveled cavity; and a groove extending from the beveled cavity;

wherein the beveled end of the male connector of each of the plurality of packer segments is configured to be received within the beveled cavity of the female connector of another of the plurality of packer segments; and wherein the tongue of the male connector of each of the plurality of packer segments is configured to be received within the groove of the female connector of another of the plurality of packer segments.

15. The packer assembly of claim 14, wherein the beveled end of each male connector comprises a planar surface that is angled relative to a central axis of the at least one packer;

wherein the beveled cavity of each female connector comprises a planar surface that is angled relative to the central axis;

wherein when the beveled end of the male connector of each of the plurality of packers segments is received within the beveled cavity of the female connector of another of the plurality of packer segments, the planar surface of the beveled end is engaged with the planar surface of the beveled cavity to form at least a portion of the non-linear leak path.

16. The packer assembly of claim 1, wherein the leak path is disjointed.

17. The packer assembly of claim 1, further comprising a spacer.

18. The packer assembly of claim 1, further comprising an o-ring.

19. The packer assembly of claim 1, wherein the male connector comprises a tongue, the tongue positioned along the one end a distance from the surface and the subsurface ends of the at least one packer.

20. The packer assembly of claim 19, wherein the tongue has tapered extensions on either side thereof.

21. The packer assembly of claim 1, wherein the packer assembly is movably supported about the telescoping assembly between portions of a seal assembly.

22. The packer assembly of claim 1, wherein the packer assembly is connected between first and second portions of a seal assembly, the first portion connected to an inner barrel of the telescoping assembly, the second portion connected to an outer barrel of the telescoping assembly.

23. The packer assembly of claim 1, wherein the telescoping assembly comprises inner and outer barrels with the packer assembly forming a seal therebetween.

24. The packer assembly of claim 1, further comprising a compression ring.

25. A telescoping assembly for operatively connecting a surface end of a subsea riser to a platform, a subsea end of the riser operatively connectable to subsea equipment, the telescoping assembly comprising:

an inner barrel operatively connectable to the platform;

an outer barrel operatively connectable to the subsea riser, wherein the outer barrel slidingly receives the inner barrel therein; and at least one seal assembly positionable about the inner and outer barrels, wherein the at least one seal assembly is configured to form a seal thereabout, wherein the at least one seal assembly comprises:

a packer housing configured to sealably connect portions of a telescoping assembly, wherein the telescoping assembly is positioned along the subsea riser and operatively connects the subsea riser to the platform; and at least one packer positionable along an inner surface of the packer housing to form the seal with the telescoping assembly, the at least one packer comprising a plurality of packer segments, wherein each of the plurality of packer segments has a male connector on one end and a female connector on another end thereof, wherein the female connector of each of the plurality of packer segments is configured to mate with and form a seal connection with the male connector of another of the plurality of packer segments, wherein the seal connection defines a non-linear leak path configured to resist leakage of fluid between the plurality of packer segments, and wherein the non-linear leak path extends from a surface end to a subsurface end of the at least one packer.

26. The telescoping assembly of claim 25, wherein the at least one seal assembly comprises a platform flange operatively connectable to the platform and a platform seal.

27. The telescoping assembly of claim 25, wherein the at least one seal assembly further comprises a collar, a latching mechanism, a guide ring, and bracing.

28. The telescoping assembly of claim 25, wherein the at least one seal assembly further comprises bellows, a bellows cover, an adapter spool, and an inner barrel locking collar.

29. The telescoping assembly of claim 25, further comprising a shoe assembly.

30. The telescoping assembly of claim 29, wherein the shoe assembly comprises a shoe and a riser flange.

31. A method of forming a seal about a subsea riser, the subsea riser operatively connected to a platform by a telescoping assembly, the method comprising:

providing the telescoping assembly with at least one packer assembly comprising:

a packer housing sealably connecting portions of the telescoping assembly, the telescoping assembly positioned along the subsea riser and operatively connecting the subsea riser to the platform; and at least one packer positionable along an inner surface of the packer housing to form a seal with the telescoping assembly, the at least one packer comprising a plurality of packer segments, wherein each of the plurality of packer segments has a male connector on one end and a female connector on another end thereof;

resisting leakage of fluid between the plurality of packer segments by forming a seal connection with a non-linear leak path between the male and female connectors by matably connecting the male connector of each of the plurality of packer segments with the female connector of another of the plurality of packer segments, the non-linear leak path extending from a surface end to a subsurface end of the at least one packer.

32. The method of claim 31, wherein the resisting further comprises squeezing the plurality of packer segments together in response to hydraulic pressure.

33. The method of claim 31, wherein the at least one packer comprises an inner packer and an outer packer, the resisting further comprising pushing the outer packer against the inner packer in response to hydraulic pressure.

34. The method of claim 31, wherein the resisting further comprises compressing the at least one packer into the packer housing with a compression ring.

* * * * *